United States Patent [19]

Krause

[11] 4,271,883

[45] Jun. 9, 1981

[54] STORAGE ARRANGEMENT

[76] Inventor: Walter Krause, Am Schalkstein 11, 7121 Walheim, Wuertt., Fed. Rep. of Germany

[21] Appl. No.: 885,258

[22] Filed: Mar. 10, 1978

[51] Int. Cl.[3] ..... B65D 30/10

[52] U.S. Cl. ..... 150/1; 222/181

[58] Field of Search ..... 150/0.5, 1; 222/185, 222/181, 105, 18, 187; 141/337, 340

[56] References Cited

U.S. PATENT DOCUMENTS

| | | | |
|---|---|---|---|
| 1,941,871 | 1/1934 | Struve | 220/404 X |
| 2,073,914 | 3/1937 | Wilfley | 150/1 |
| 2,227,706 | 1/1941 | Conner | 222/181 X |
| 2,253,688 | 8/1941 | Collins | 150/1 X |
| 2,740,445 | 4/1956 | Fornell | 150/1 |
| 3,018,880 | 1/1962 | Brugmann | 150/1 |
| 3,028,895 | 4/1962 | Gooding | 150/1 |
| 3,292,813 | 12/1966 | Roegner | 150/1 |

FOREIGN PATENT DOCUMENTS

| | | | |
|---|---|---|---|
| 493163 | 3/1930 | Fed. Rep. of Germany | 150/1 |
| 1185581 | 8/1959 | France | 150/1 |
| 2304537 | 10/1976 | France | 150/1 |
| 1317398 | 5/1973 | United Kingdom | 150/1 |
| 1340693 | 12/1973 | United Kingdom | 150/1 |

*Primary Examiner*—Allan N. Shoap
*Attorney, Agent, or Firm*—Michael J. Striker

[57] ABSTRACT

A storage arrangement comprises a container formed by a circumferential wall of flexible material and having an axis, and suspendable so that the axis of the container extends in an upright direction. The container has an upper end, a lower end and an axial cross-section which has sides spaced from one another in direction transverse to the axis and decreases in direction from the upper end toward the lower end. The axial cross-section of the container includes at least one axial portion laterally bounded by sections of the sides, which sections are non-straight in the direction from the upper end toward the lower end of the container. The arrangement has elements for suspending the container so that the axis thereof extends in the upright direction. The sections of the sides of the axial cross-section of the container may gradually approach one another. On the other hand, the sections of the sides of the axial cross-section of the container may approach one another in a stepped manner.

7 Claims, 11 Drawing Figures

STORAGE ARRANGEMENT

BACKGROUND OF THE INVENTION

The present invention relates to a storage arrangement, comprising a container of flexible material.

Storage arrangements comprising a container of flexible material have been proposed in the art. It has been recognized that the known flexible containers, particularly those having great capacities, become elongated under the action of the weight of the substances which fill the container. This is especially characteristic in the case when the content of the container reduces and only a part of the container is loaded so that the container becomes deformed and the lower portion thereof contracts and assumes a pear-like configuration. Since such container is generally connected to rigid discharging device or dosing device, transverse folds are formed and overhanging occurs in this case, that question unobjectionable discharge of substances from the container.

In order to eliminate the above disadvantage a container has been proposed which has an upper cylindrical or prismatic portion, and a lower portion having a shape of a cone or a truncated pyramid. A reinforcing ring is provided, inserted in a pocket-shaped edge in the region between the upper portion and the tapered lower portion of the container and spreading the upper portion of the container so as to hold the same. This construction has the disadvantage that the reinforcing rings substantially increase the weight of the container, leaving out of account the fact that the reinforcing rings during manufacture of the same require considerable additional expenditures of material and labor time.

SUMMARY OF THE INVENTION

Accordingly, it is an object of the present invention to provide a storage arrangement which avoids the disadvantages of the prior art.

More particularly, it is an object of the present invention to provide a storage arrangement whose flexible container is not subjected to undesirable elongation and formation of folds during discharge of a substance therefrom, and simultaneously a lower part of the container does not require the utilization of a reinforcing ring.

In keeping with these objects, and with others which will become apparent hereinafter, one feature of the present invention, briefly stated, resides in a storage arrangement whose container having an axis and suspendable in an upright position has a cross-section decreasing in direction from an upper end towards a lower end of the container and including at least one axial portion laterally bounded by sections of sides of the container which sections are non-straight in the direction from the upper end toward the lower end of the container.

When the container of the storage arrangement is constructed in accordance with the present invention, the container in filled condition assumes a shape which corresponds to the shape assumed by a container having a cylindrical or prismatic upper portion and gradually linearly tapered lower portion during discharge operation, when no reinforcing ring is provided. Due to bulging of walls of the container under the action of the weight of the substances accommodated in the same, the container in the upper portion thereof assumes the original polygonal cross-section with a curved shape. It has been shown that the container in accordance with the invention keeps its shape during the entire discharge process until full emptying of the container. The thus-formed container does not require to utilize a reinforcing ring in the transition region between the upper portion and the lower portion of the container, which reinforcing ring caused the above disadvantages in the prior art.

Another feature of the present invention is that the sections of the sides of the axial cross-section of the container may gradually approach one another. In this case each of the sections of the sides of the axial cross-section may extend along a curved line or along an arcuate curved line.

Still another feature of the present invention is that the sections of the sides of the axial cross-section of the container may approach one another in a stepped manner. In this case each of the sections of the sides of the axial cross-section may extend along a stepped line or along a broken stepped line. The above sections of the sides of the axial cross-section form a plurality of zones located within the axial portion and arranged in consecutive order in the direction from the upper end toward the lower end of the container.

A further feature of the present invention is that the container has suspending means which includes loop-shaped members adjacent to the upper end of the container and extending in a circumferential direction of the wall of the container. The above loop-shaped members are suspended on rigid support means which is profiled in accordance with the transverse cross-section of the container. The loop-shaped members may be of one piece with the wall of the container. The together may form an integral member which is cut from a sheet of flexible material in correspondence with a development of the container.

A still further feature of the present invention is that the sides of the axial cross-section of the container may gradually approach one another along their entire length, or may approach one another in a stepped manner along their entire length.

An additional feature of the present invention is that the cross-section of the container may include one or several such axial portions with gradually approaching side sections, and a remainder portion whose sides are straight or approach one another in a stepped manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
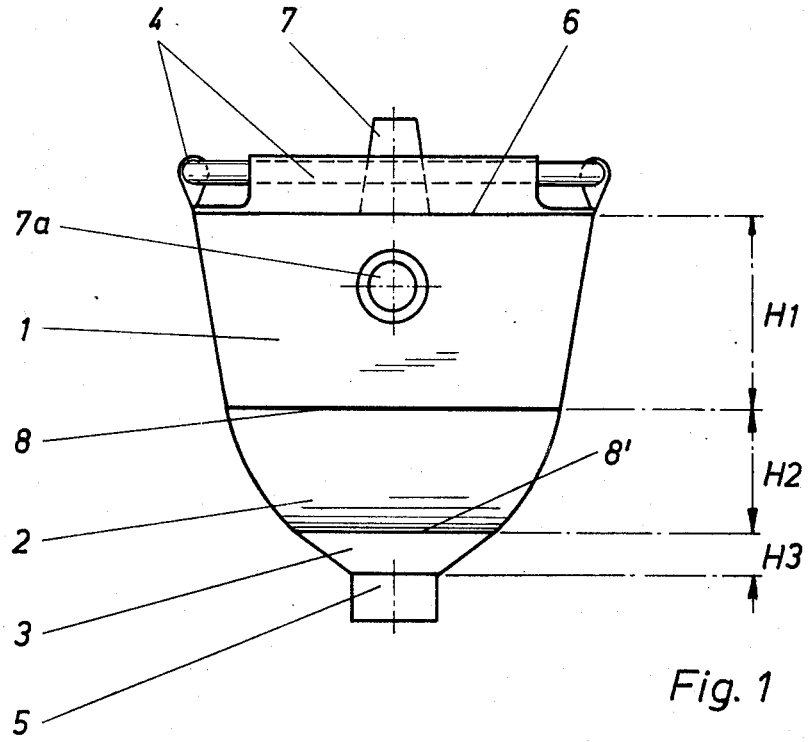
FIG. 1 is side view of a container of a storage arrangement in accordance with the invention.

FIG. 1 shows a container of a storage arrangement, including an upper portion 1 which has a length H1 and straight sides. The upper portion 1, in the selected case, has the shape of an upwardly tapered truncated pyramid which is limited by rectilinear edges. In this case sides of an axial cross-section of the upper portion of the container gradually linearly approach one another. Loop-shaped members 4 extend along upper edges of the upper portion 1 and are of one piece with a wall of the upper portion 1. The loop-shaped members 4 may be suspended on a profiled rigid frame so as to hold the container in an upright position. The container may be upwardly open, however, in the selected case the container is closed from above by a cover 6 provided with an inlet nozzle 7. An additional inlet nozzle 7*a* is arranged in one of the side walls of the container, which is necessary especially in the case when the container is located adjacent to a ceiling of a storage chamber and for this reason cannot be filled from above.

An intermediate portion 2 of the container is connected with the upper portion 1 having the shape of a truncated pyramid, along line 8 and has a length H2. Walls of the intermediate portion 2 is curved so that this portion is downwardly tapered. The sides of the intermediate portion 2 are not straight, however, they preferably gradually approach one another. Contact edges of the curved walls of the intermediate portion 2 extends along curves.

A lower portion 3 of the container has a length H3 and is connected to the intermediate portion 2 along line 8'. The lower portion 3 is bounded by flat surfaces and has the shape of a truncated pyramid whose axial cross-section has sides which gradually linearly approach one another. A lower end of the lower portion 3 having the shape of a truncated pyramid is provided with an outlet nozzle 5.

It has been shown that when the container is formed as above, the container during the entire discharge operation keeps its form and does not have tendency to form horizontal folds or to overhang when it is fixedly connected to additional means.

Figure 3:
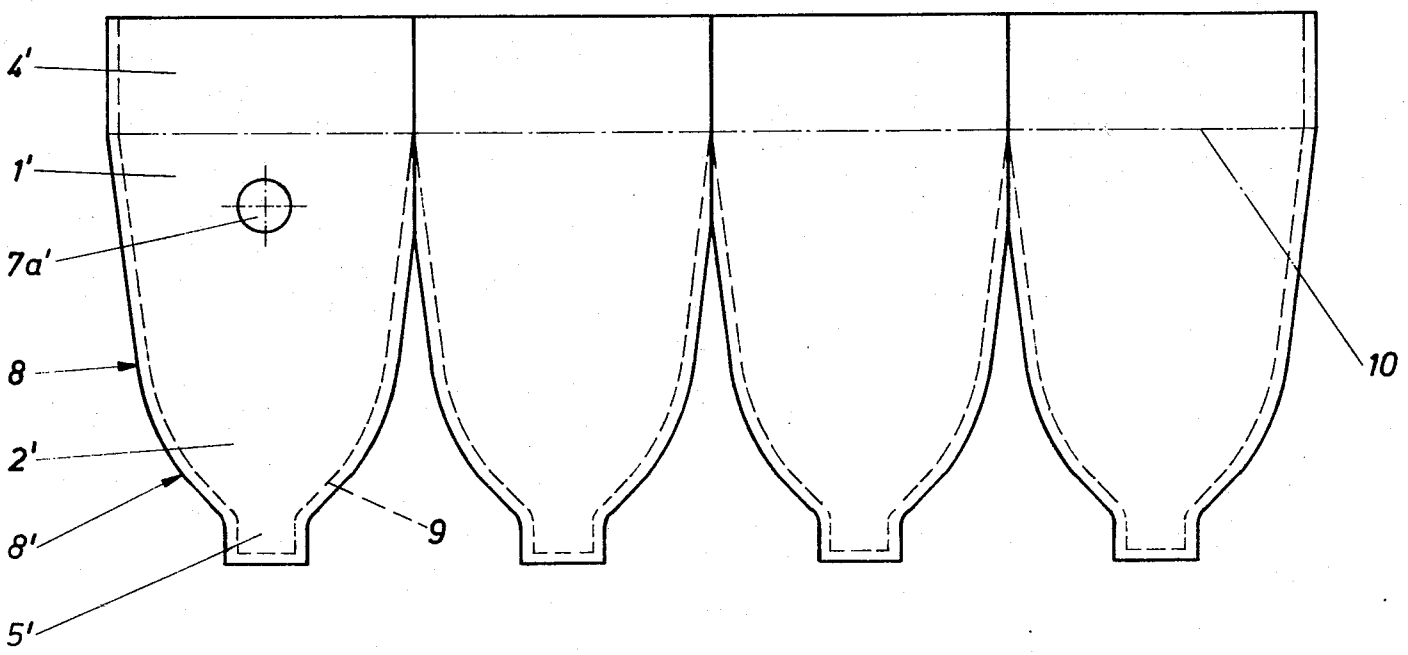
FIG. 3 is a view showing a developed preform of the container; shown in FIG. 1

It is advantageous when the container has minimum seams for manufacturing the same. In accordance with an especially advantageous embodiment of the invention the entire container is manufactured from one sheet of material which is cut so as to correspond to a development of the container. FIG. 3 shows such sheet of material. The sheet has an upper portion 4' which forms during manufacturing the container the loop-shaped members 4. A portion of the sheet which forms a filling space of the container begins from a dotted line 10. Portions 1' of the sheet forms the upper portion 1 of the container. Edges of the portions 1' extend along lines corresponding to the sides of the upper portion 1 of the container up to the line 8. Then, the above straight edges merge into curved edges which correspond to the sides of the intermediate portion 2 of the container and bound portions 2' of the sheet. The curved edges of the portins 2' extend up to the line 8' and then merge into straight edges corresponding to the side of the lower portion 3 of the container and bounding portions 3' of the sheet. Portions 5' are connected to the portions 3' and form the outlet nozzle 5 of the container. This embodiment of the invention provides for the special advantage that in the regions of transition from one portion of the sheet to an adjacent portion no horizontal seam is necessary, which horizontal seams in the art were very dangerous.

In central region of the portion 1' of the sheet an opening 7*a*' is provided for insertion of the lateral inlet nozzle 7*a*. It is understood that the sheet is cut along lines which extend in due regard with the location of seams. The location of a seam 9 is identified by a dotted line, and the seam extends along lines corresponding to edges of the respective portions of the sheet and the sides of the respective portions of the container.

Figure 2:
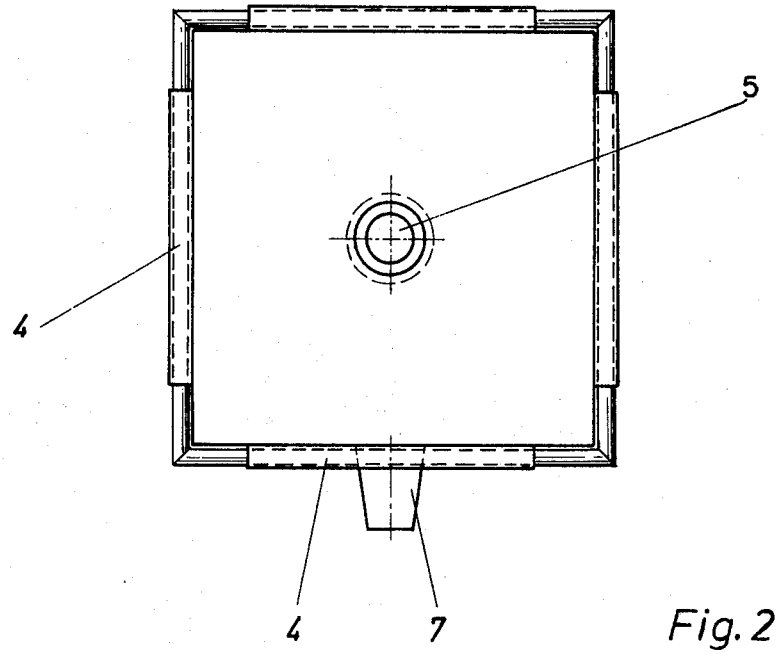
FIG. 2 is a plan view of the container of the storage arrangement in accordance with the invention, shown in FIG. 1.
Figure 4:
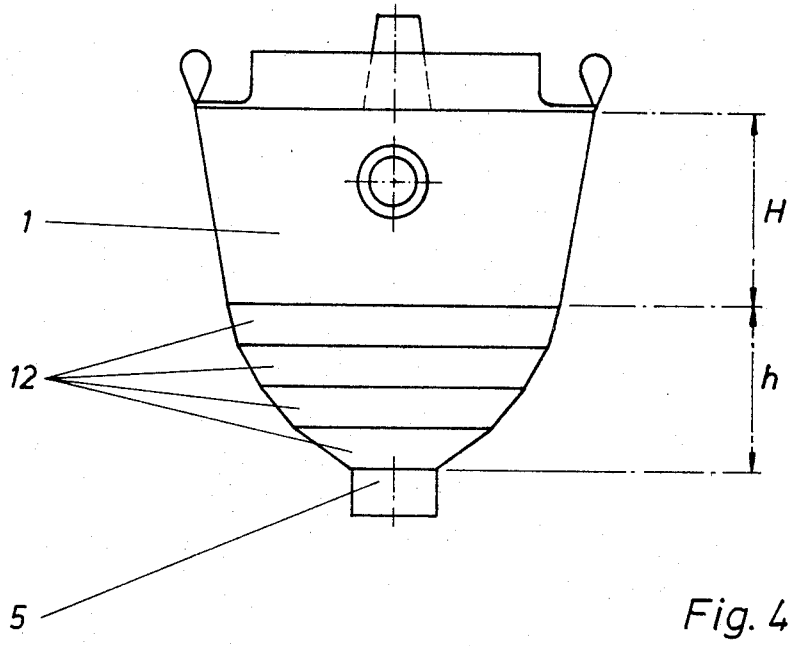
FIG. 4 is a side view of a container of a storage arrangement in accordance with another embodiment of the present invention.

It has to be understood that the container shown in FIGS. 1–3 is taken only as an example. It is possible to provide a container which includes a greater number of portions having identical or different heights. For instance, the container may include several portions whose axial cross-sections are bounded by straight lines having, however, different inclinations so that the axial cross-section of the container decreases from one portion to another portion of the container in a stepped manner, as shown in FIG. 4. In this case, the container includes the upper portion 1 having the shape of a truncated pyramid and a height H, and a lower portion having a height h and including a plurality of sections 12 each of which has the shape of a truncated pyramid. Walls or sides of the sections 12 enclose different angles with the horizontal line. The sides of the axial cross-section of the lower portion approach one another in a stepped manner.

On the other hand, the container may be formed as shown in FIG. 1, however, in such a manner that the entire upper portion including the portions 2 and 3 of FIG. 1 can have curved side walls. There is also a possibility that the sides of the axial cross section of the container may be non-straight and gradually approach one another along the entire length of the sides of the axial cross section. In other words, the side walls of the container may be formed as a whole by curved surfaces. It is also possible that the entire container may be formed by a plurality of small portions which are similar to the portions 12 shown in FIG. 4, so that the sides of the axial cross-section of the container approach one another over the entire length of the sides in a stepped manner.

Figure 5:
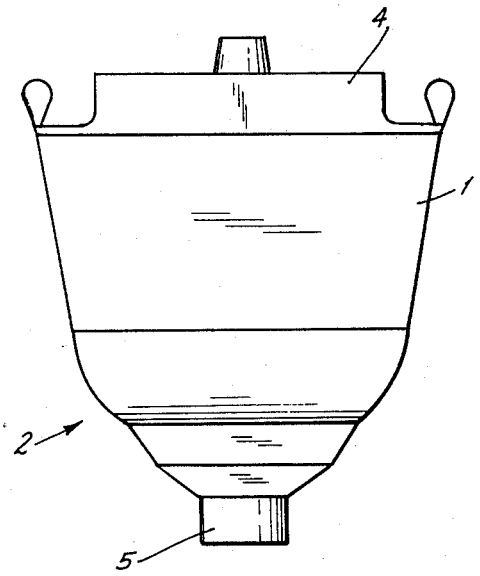
FIG. 5 is a side view of a container in accordance with a third embodiment of the present invention.
Figure 6:
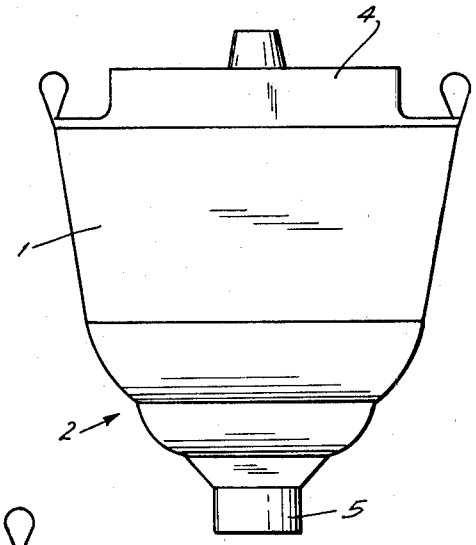
FIG. 6 is a side view of a container in accordance with a fourth embodiment of the present invention.
Figure 7:
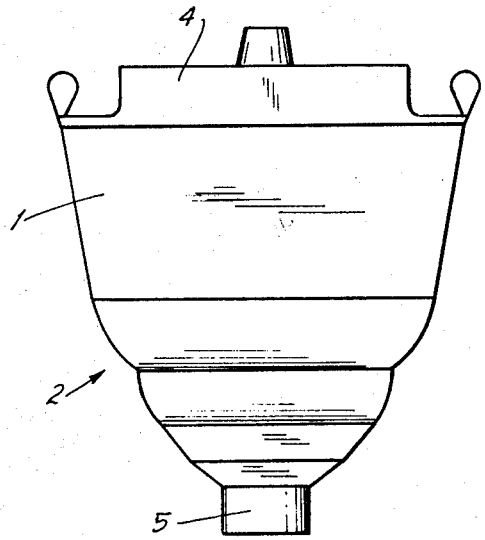
FIG. 7 is a side view of a container in accordance with a fifth embodiment of the present invention.
Figure 8:
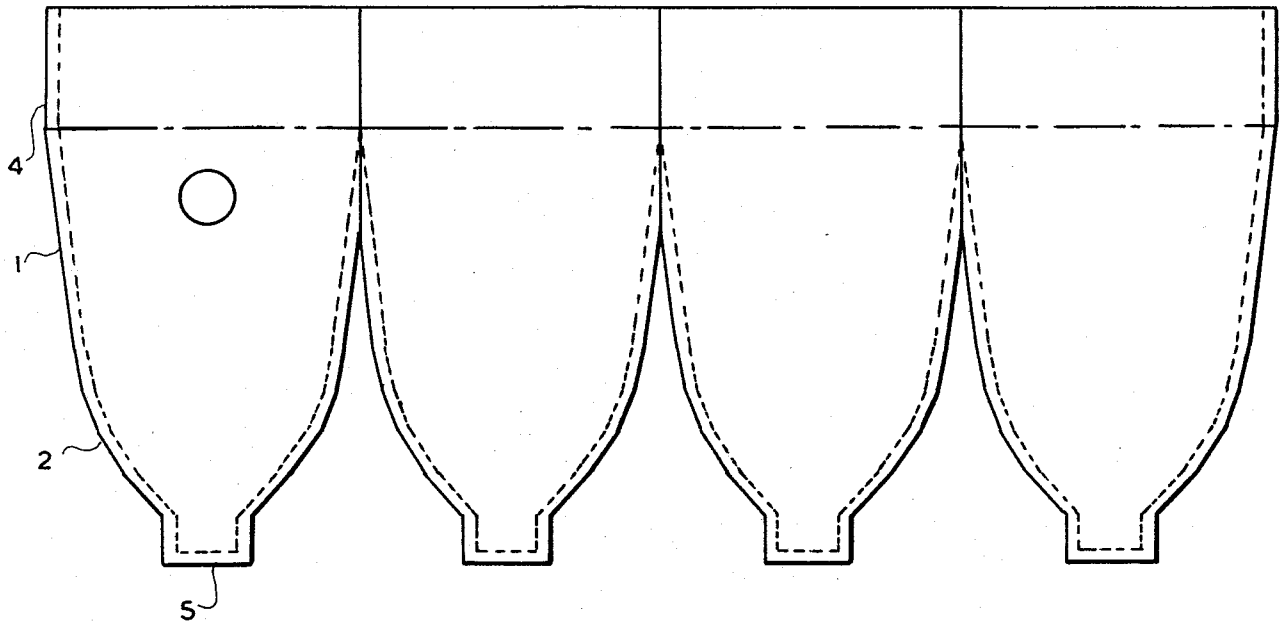
FIG. 8 is a view showing a developed preform of the container shown in FIG. 4.
Figure 9:
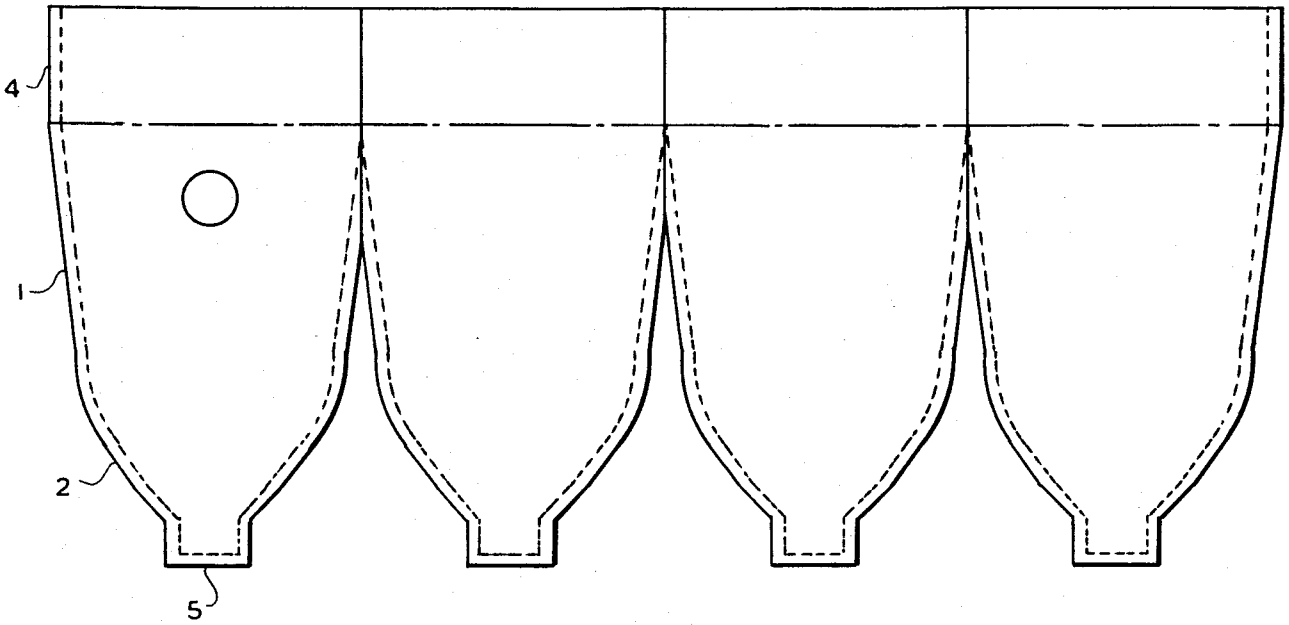
FIG. 9 is a view showing a developed preform of the container shown in FIG. 5.
Figure 10:
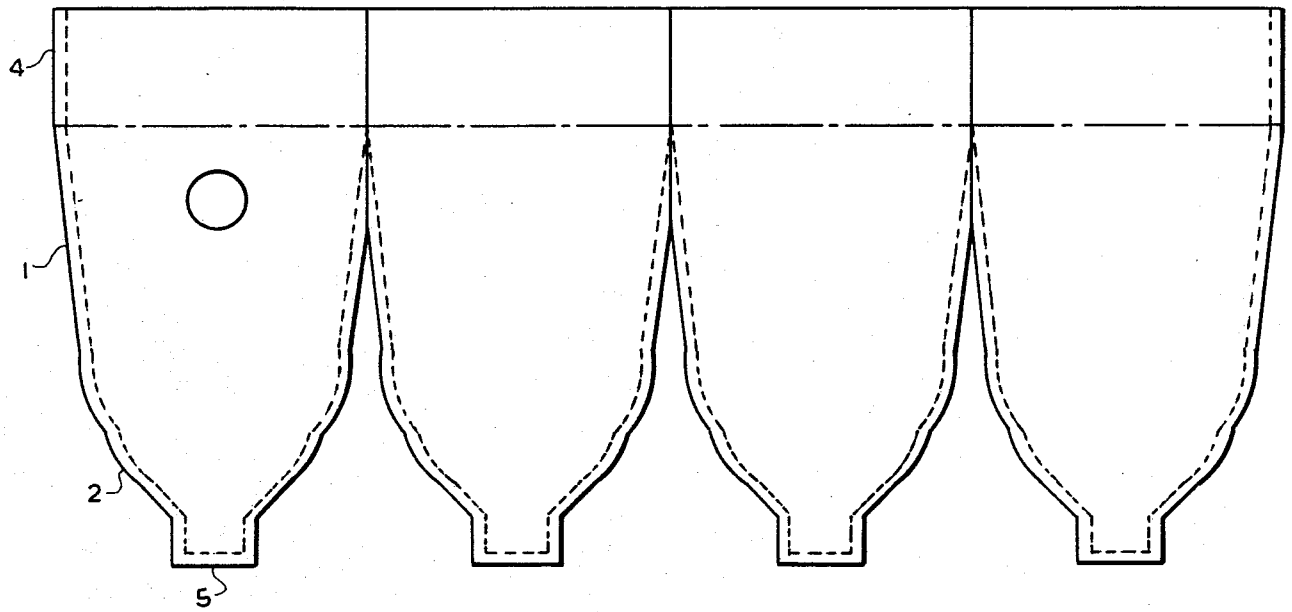
FIG. 10 is a view showing a developed preform of the container shown in FIG. 6.
Figure 11:
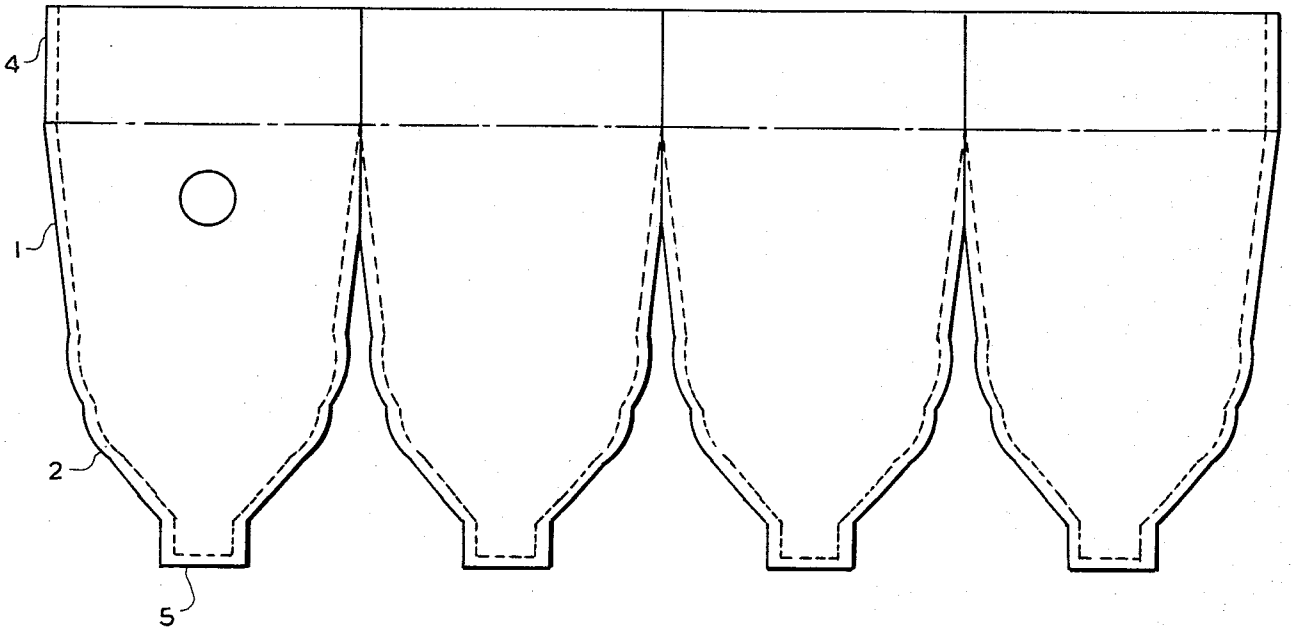
FIG. 11 is a view showing a developed preform of the container shown in FIG. 7.

FIG. 5–7 show various embodiments of the container in accordance with the present invention.

The axial cross-section of the container may include one or several sections similar to the intermediate section 2 whose sides gradually approach one another, and a remainder portion whose sides are straight or approach one another in a stepped manner, as shown in FIG. 5.;

FIG. 6 shows the intermediate section including a plurality of surfaces bounded with curvative lines and a last portion bounded with straight lines;

FIG. 7 shows the intermediate section formed with a plurality of portions having surfaces bounded with curvative lines and a number of surfaces bounded with straight lines.

The container is constituted by a flexible synthetic plastic material which may be manufactured from an air-permeable fabric, or may be made air-permeable by suitable impregnation. It is to be understood that also fabric of natural fibers or pure synthetic plastic films can be utilized.

In the above examples the portions of the sheet are connected with one another by seams so as to form the container of the required shape. However, it is to be understood that various methods may be used for connecting the edges of the sheet, such as a glueing process or a welding process.

FIGS. 8 through 11 illustrate "blanks" for forming containers of the shapes shown in FIGS. 4–7 respectively.

In order to support the frame on which the loop-shaped members 4 of the container are suspended, it is advantageous to form the loop-shaped members so that they are terminated at a short distance from corners of the upper surface of the container and form gaps therebetween. In this case the frame extends outwardly beyond the loop-shaped members and into the gaps therebetween so that it can be supported by a support structure or suspended by means of suspension on a ceiling of the storage chamber.

It will be understood that each of the elements described above, or two or more together, may also find a useful application in other types of constructions differing from the types described above.

While the invention has been illustrated and described as embodied in a storage arrangement, it is not intended to be limited to the details shown, since various modifications and structural changes may be made without departing in any way from the spirit of the present invention.

Without further analysis, the foregoing will so fully reveal the gist of the present invention, that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A storage container made from a unitary sheet of flexible material folded to form a body having a continuous periphery and further comprising an upper end and a lower end and a side wall extending therebetween and defining at said upper end a material inlet having a rectangular periphery and at said lower end a material outlet having a cylindrical periphery, said continuous periphery of said body decreasing peripherally from said upper end toward said lower end, said side wall having a geometric shape different from said upper end and said lower end and having an upper portion and a lower portion and an intermediate portion therebetween, said upper portion merging into said intermediate portion at a perimetric line formed therebetween, said intermediate portion merging into said lower portion at a perimetric line formed therebetween, said lower portion merging into said lower end and each of the portions converging in a direction downwardly towards said lower end with the angle of convergence being different in each portion, said upper portion forming a substantially conical periphery, said upper end having a height substantially smaller than the height of said upper portion; and means for suspending the container located at said upper end.

2. The storage container of claim 1, wherein said upper end is square-shaped.

3. The storage container of claim 1, wherein said intermediate portion of said side wall has a longitudinal curvature.

4. The storage container of claim 1 wherein said intermediate portion is in stepped sections.

5. The storage container of claim 1, wherein said intermediate portion has a cross-section defined with a plurality of curvative lines successively merging one into another and a plurality of straight lines successively merging one into another, said curvative lines merging into said straight lines.

6. The storage container of claim 1, wherein said means for suspending the container include loop-shaped members.

7. The storage container of claim 1, wherein said means for suspending the container are formed integrally with said side wall.

* * * * *